US007114573B2

(12) United States Patent
Hirth et al.

(10) Patent No.: US 7,114,573 B2
(45) Date of Patent: Oct. 3, 2006

(54) HYDRAULIC SETTING TOOL FOR LINER HANGER

(75) Inventors: David E. Hirth, Pasadena, TX (US); Patrick G. Maguire, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/850,349

(22) Filed: May 20, 2004

(65) Prior Publication Data

US 2005/0006106 A1 Jan. 13, 2005

Related U.S. Application Data

(60) Provisional application No. 60/471,870, filed on May 20, 2003.

(51) Int. Cl.
*E21B 43/10* (2006.01)
*E21B 23/01* (2006.01)

(52) U.S. Cl. ..... 166/382; 166/208; 166/212

(58) Field of Classification Search ..... 166/382, 166/383, 123, 134, 143, 208, 217, 209, 211, 166/212, 117
See application file for complete search history.

(56) References Cited

U.S. PATENT DOCUMENTS 3,455,381 A * 7/1969 Page, Jr. ..... 166/121
3,460,617 A 8/1969 Brown et al.
3,519,074 A * 7/1970 Berryman ..... 166/123
3,608,634 A * 9/1971 Cochran ..... 166/208
4,049,055 A * 9/1977 Brown ..... 166/278
4,249,601 A 2/1981 White
4,311,194 A 1/1982 White
5,086,845 A 2/1992 Baugh
5,318,131 A * 6/1994 Baker ..... 166/382
6,321,847 B1 * 11/2001 Brown ..... 166/374

OTHER PUBLICATIONS

PCT Search Report, International Application No. PCT/US2004/015778, dated Oct. 11, 2004.
PCT Search Report, International Appication No. PCT/US04/15778, dated Sep. 16, 2005.

* cited by examiner

*Primary Examiner*—Kenneth Thompson
(74) *Attorney, Agent, or Firm*—Patterson & Sheridan, LLP

(57) ABSTRACT

Embodiments of the present invention relates to hydraulically actuated tools, which may be used to actuate a liner hanger assembly. In one embodiment, the present invention provides a hydraulic setting tool for use in wellbore operations. The setting tool includes a first tubular member and a second tubular member disposed around the outer diameter of the first tubular member. A piston is mechanically attached to an upper portion of the second tubular member and adapted to move axially in relation to the first tubular member. The piston acts to transmit a force to the second tubular member. A slip assembly is operatively connected to the second tubular member and the second tubular member transmits the force to the slip assembly thereby actuating the slip assembly.

15 Claims, 8 Drawing Sheets

HYDRAULIC SETTING TOOL FOR LINER HANGER

CROSS-REFERENCE TO RELATED APPLICATIONS

This application claims benefit of U.S. Provisional Patent Application Ser. No. 60/471,870, filed on May 20, 2003, now abandoned which application is incorporated by reference herein in its entirety.

BACKGROUND OF THE INVENTION

1. Field of the Invention

Embodiments of the present invention generally relate to methods and apparatus for completing a well. Particularly, embodiments of the present invention relate to hydraulically actuated tools, which may be used to set a liner hanger assembly.

2. Description of the Related Art

In the drilling of oil and gas wells, a wellbore is formed using a drill bit that is urged downwardly at a lower end of a drill string. After drilling to a predetermined depth, the drill string and the bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps with the lower portion of the upper string of casing. The second "liner" string is then fixed or "hung" off of the inner surface of the upper string of casing. Afterwards, the liner string is also cemented. This process is typically repeated with additional liner strings until the well has been drilled to total depth. In this manner, wells are typically formed with two or more strings of casing of an ever-decreasing diameter.

The process of hanging a liner off of a string of surface casing or other upper casing string involves the use of a liner hanger. The liner hanger is typically run into the wellbore above the liner string itself. The liner hanger is actuated once the liner is positioned at the appropriate depth within the wellbore. The liner hanger is typically set through actuation of slips which ride outwardly on cones in order to frictionally engage the surrounding string of casing. The liner hanger operates to suspend the liner from the casing string. However, it does not provide a fluid seal between the liner and the casing. Accordingly, it is desirable in many wellbore completions to also provide a packer.

During the wellbore completion process, the packer is typically run into the wellbore above the liner hanger. A threaded connection typically connects the bottom of the packer to the top of the liner hanger. Known packers employ a mechanical or hydraulic force in order to expand a packing element outwardly from the body of the packer into the annular region defined between the packer and the surrounding casing string. In addition, a cone may be driven behind a tapered slip to force the slip into the surrounding casing wall and to prevent upward packer movement. Numerous arrangements have been derived in order to accomplish these results.

Liner top packers are commonly run with liner hangers to provide a fluid barrier for the annular area between the casing and the liner. Liner top packers run with liner hangers typically include a tubular member with a seal bore in it that is run on the top end of the packer. This tubular member is commonly referred to as a polished bore receptacle (PBR) or tieback receptacle. This PBR provides a means for a tieback with a "seal stem" or tubular at a later date for remediation or production purposes. The liner top packers are typically set by compressive force transmitted to the packer from the landing string through the PBR. There is typically a seal or seals between the PBR and the body of the packer that allow axial motion of the PBR relative to the liner top packer body. These seals become an integral part of the wellbore when the PBR is tied back. These seals are typically constructed from elastomers, which must be carefully selected to ensure fluid and temperature compatibility with the anticipated downhole conditions. If these seals were to leak, costly remediation would be required.

Hydraulic liner hangers typically have ports disposed through the wall of the liner hanger body that allow fluid to pass into a hydraulic cylinder or piston located external to or in the wall of the liner hanger body. As pressure is applied to the cylinder or piston, a mechanical force is generated to urge the slips up the taper of the cones until they frictionally engage the slips with the inside of the casing wall. This mechanical force is typically imparted along the axis of the liner hanger body or parallel to the axial movement of the slips. Once the slips are actuated and the liner hanger is set, the cylinder or piston and the respective seals become an integral part of the wellbore and are required to function for the life span of the well. The ports and seals disposed between the cylinder or piston and the liner hanger body create potential leak paths. Failure of the cylinder or piston or the respective seals will typically result in costly remedial work to repair the leak. In addition, high downhole temperatures place great demands on the elastomer seals typically used in conjunction with the cylinders or pistons in hydraulic liner hangers. High downhole pressures induce high burst and collapse loads on the hydraulic cylinder or piston along with imparting additional stresses on the seals. The required thickness of the cylinder or piston can create compromises in liner hanger body thickness, which would reduce the pressure and load capacity of the liner hanger body.

Hydraulic liner hangers typically have an actuating control mechanism consisting of shear screws or rupture discs that prevent movement of the hydraulic cylinder or piston to prevent actuation of the slips until a specific internal pressure has been reached. If this pressure is exceeded or the actuating control mechanism is prematurely actuated, the slips will be activated and any subsequent hydraulic pressure will directly act on the cylinder or piston to set the slips. If the actuation control mechanism is actuated late, other hydraulic equipment may be actuated out of the desired sequence. The relatively small piston area of a typical hydraulic cylinder combined with the relatively large seals required to place the cylinder around the liner hanger body can lead to unfavorable ratios of activation force to seal friction, which in turn can lead to inaccuracies in the activation pressures.

Typically, the hydraulic cylinders or pistons for hydraulic liner hangers come into contact with wellbore production fluids and are thus considered flow-wetted parts. The hydraulic cylinders or pistons are typically constructed from the same material as the liner body being used to ensure compatibility with the production fluids. This can significantly increase the cost of construction of the liner hanger assembly.

In challenging well conditions, such as horizontal wells or wells with debris or contaminants, the force required to activate the slips on the liner hanger is critical for successful hanger operation. In deviated or horizontal wells, solids may fall out of suspension from the drilling fluids and accumulate on the lower side of the wellbore. In horizontal or deviated wellbore operations, the liner hanger typically rides on the lower side of the wellbore during run in. The liner hanger slips that are located on the low side of the wellbore are required to move up the cone during actuation in order to engage the casing. Furthermore, all of the slips on the slip assembly are axially fixed together to ensure centralization of the liner and to provide for an even loading of the slips onto the inner surface of the casing. If the slips disposed on the lower side are allowed to contact the casing before the remaining slips, then the remaining slips will not engage the casing until the cones become centralized in the wellbore. Since the plurality of cones is disposed on the liner hanger body, the liner will have to be lifted by the lower slips to centralize the cones, which can require a considerable force. If insufficient hydraulic force is available to centralize the liner alone, then a combination of hydraulic force on the slips and downward movement of the cone and liner will be required to hold the slips stationary while the cones ride up the slips. If the friction of the slips on the lower side of casing combined with the hydraulic force on the slips is less than the force required to "ramp" the cones up the slip, then the cones will not ride up the slips sufficiently to radially extend the slips to a point where the remaining slips become engaged with the casing.

If the liner being run into the wellbore is short in length or very light in weight, it can be challenging to determine whether the running tools have been released from the liner by simply raising the landing string. Difficulty in determining whether the running tools have been released can also be incurred if the well is deviated or horizontal. Release of the running tools from the liner can be determined by a loss of weight from the landing string. To overcome this challenge, liners may also be run with hold down devices, such as a hydraulic actuated hold down sub that provides a means of anchoring the liner so that it will resist upward movement. Also bi-directional gripping slip devices are known to maintain the compressive force in the slips that is applied to the liner hanger after it is set. However, if the liner is in a deviated well, then applying adequate compressive force can prove difficult due to the frictional drag created between the wellbore and the landing string. Currently, hold-down devices and known bi-directional slip devices add considerable complexity to the liner hanger assembly, in particular when utilized with rotating liner applications.

As a liner is run into a wellbore, fluid along with cuttings and other solids are displaced from the well bore and urged past the outside of the liner. When the fluid traverses past the top of the PBR and the running tools, the velocity of the fluid decreases due to entering a larger annulus. This decrease in fluid velocity negatively affects the ability of the fluid to carry solids and therefore, causes the heavier solids in the fluid to accumulate at the top of the liner. Consequently, the solids may enter the area around the running tools located within the PBR causing difficulties in releasing or retrieving the running tools.

Therefore, there is a need for an improved device and method for setting a liner within a wellbore.

SUMMARY OF THE INVENTION

The present invention generally relates to methods and apparatus for completing a well. Particularly, embodiments of the present invention relate to hydraulically actuated tools, which may be used to set a liner hanger assembly.

In one aspect, the present invention provides a setting tool for use in a wellbore. The tool comprises a first tubular member and a second tubular member disposed around the outer diameter of the first tubular member. The tool further includes a force transmission member engaged to an upper portion of the second tubular member and axially movable relative to the first tubular member, wherein the force transmission member is adapted to transmit a force to the second tubular member. The tool is equipped with a gripping member operatively connected to the second tubular member, the gripping assembly actuatable by the force transmitted to the second tubular member.

In another aspect, the present invention provides a method for setting a tool in a wellbore. The method includes disposing a first tubular around a second tubular, transmitting an axial force to the first tubular, and moving the first tubular axially relative to the second tubular. The method also includes actuating a gripping member operatively connected to the first tubular, wherein the gripping member sets the tool in the wellbore.

In one embodiment of the present invention, a hydraulic setting tool for use in wellbore operations comprises a first tubular member and a thin second tubular member disposed around the outer diameter of the first tubular member. A piston is mechanically attached to an upper portion of the second tubular member and adapted to move axially in relation to the first tubular member. The piston acts to transmit a force to the second tubular member. A slip assembly is operatively connected to the second tubular member and the second tubular member transmits the force to the slip assembly thereby actuating the slip assembly.

A method for the use of a hydraulic setting tool in wellbore operations according to one embodiment of the present invention is also provided. The hydraulic setting tool is operated by providing a first tubular member and a thin second tubular member, wherein the second tubular member is disposed around the outer diameter of the first tubular member. A force is transmitted to the second tubular member through a piston, wherein the piston is operatively connected to an upper portion of the second tubular member and adapted to move axially in relation to the first tubular member. The force is then transmitted to a slip assembly, wherein the slip assembly is operatively connected to the second tubular member thereby actuating the slip assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention generally relate to methods and apparatus for completing a well. Particularly, embodiments of the present invention relate to a thin outer sleeve disposed around a liner hanger assembly and to a plurality of hydraulic tools in combination with the thin outer sleeve used to set a liner hanger and a liner top packer.

Embodiments of the invention are described below with terms designating orientation in reference to a vertical wellbore. These terms designating orientation should not be deemed to limit the scope of the invention. Embodiments of the invention may also be used in a non-vertical wellbore, such as a horizontal wellbore.

Figure 1:
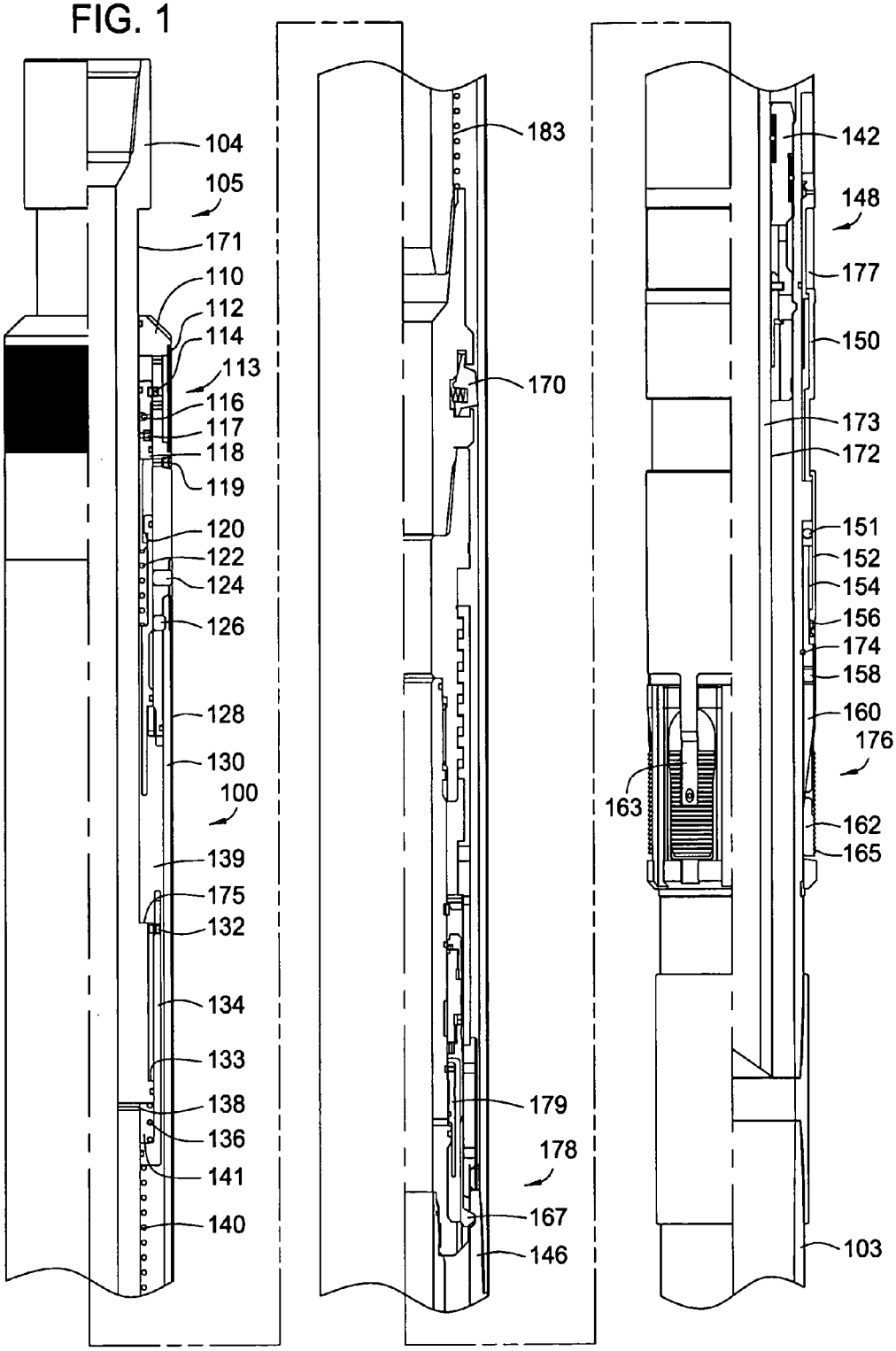
FIG. 1 shows a partial schematic view of one embodiment of a liner hanger assembly and a running tool assembly in a run-in position.
Figure 2:
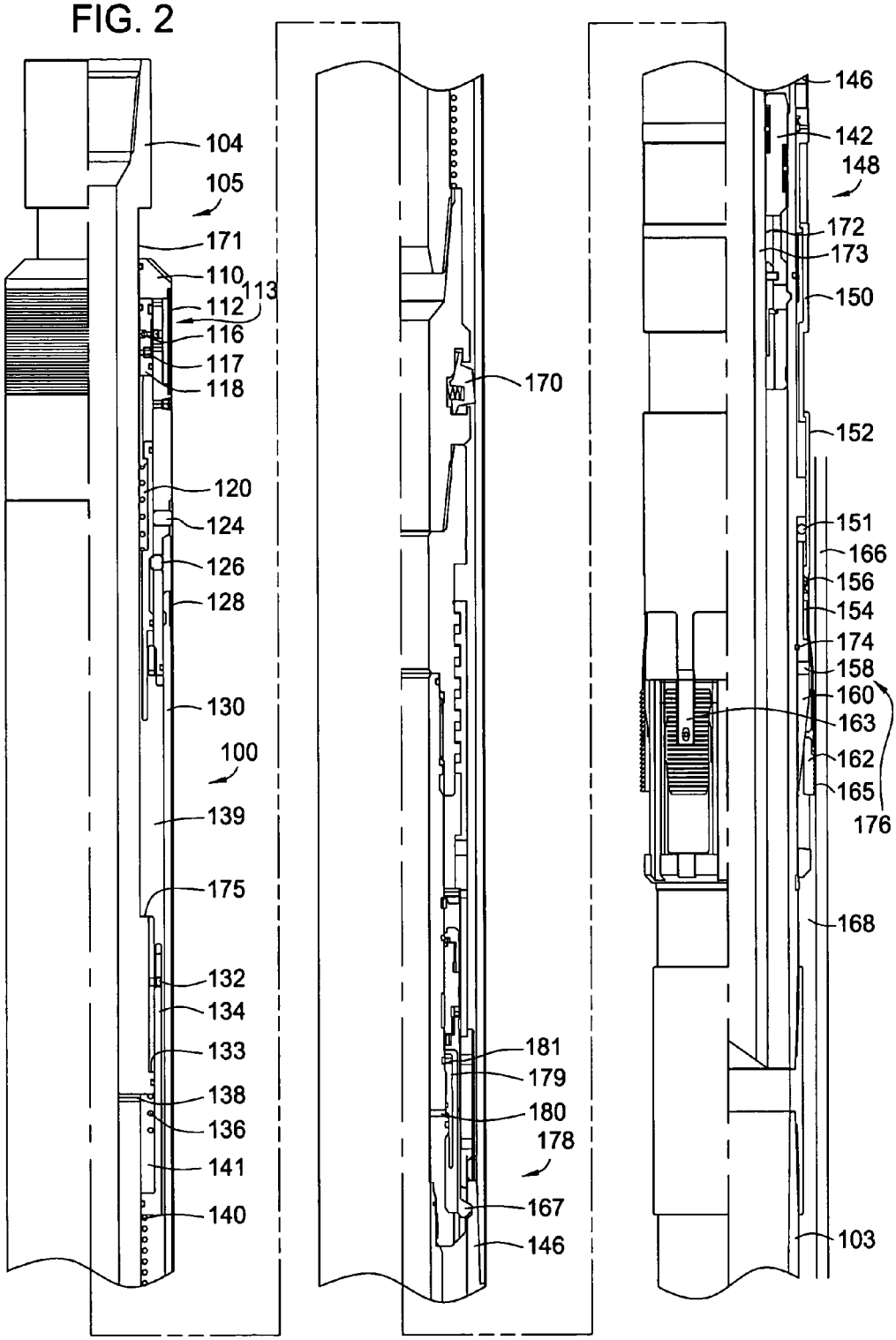
FIG. 2 illustrates a partial schematic view of the liner hanger assembly and the running tool assembly in a liner hanger actuated position, set within a wellbore.
Figure 3:
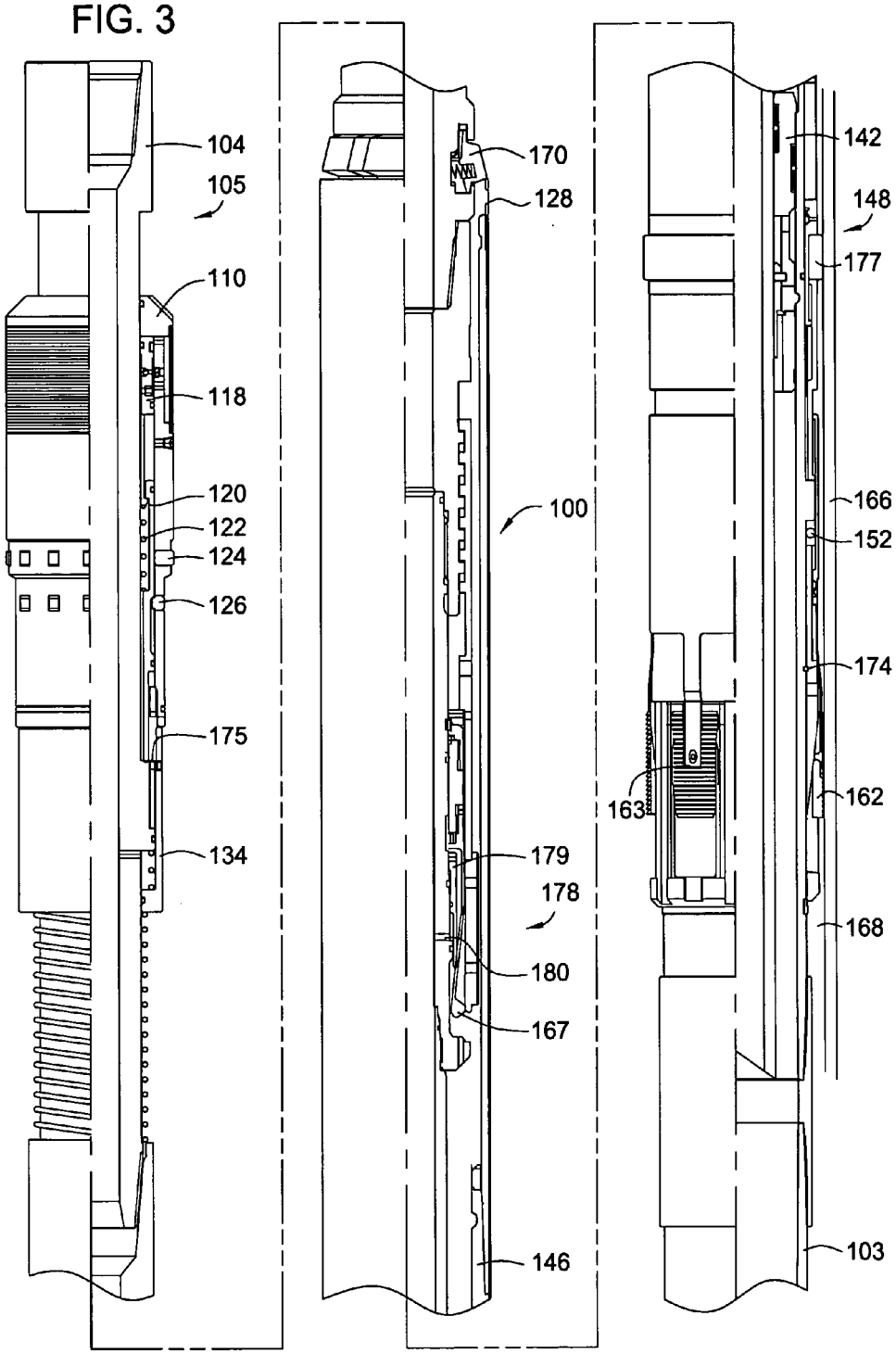
FIG. 3 provides a partial schematic view of the liner hanger assembly and the running tool assembly in a liner top packer actuated position.

FIG. 1 illustrates a partial schematic view of one embodiment of a liner hanger assembly 100 and a running tool assembly 105 in a run-in position. FIG. 2 shows a partial schematic view of the liner hanger assembly 100 and the running tool assembly 105 with the liner hanger 176 set within a wellbore. FIG. 3 shows a partial schematic view of the liner hanger assembly 100 and the running tool assembly 105 in the liner top packer actuated mode.

The liner hanger assembly 100 generally includes a polished bore receptacle (PBR) 130, a liner top packer 148, and a liner hanger 176. As shown in FIG. 1, the PBR 130 is disposed above the packer 148. In FIG. 1, the PBR 130 is shown rigidly connected to a liner body 146 by a metal to metal sealing, threaded connection; however, it is assumed that the PBR may be attached to the liner body 146 by any connection means known to a person of ordinary skill in the art or the PBR 130 can be an integral part of the liner body 146. The liner top packer 148 is shown on a common liner body 146 with the liner hanger 176; however, it is assumed that they could have two separate bodies threadedly coupled together.

The running tool assembly 105 generally includes an inner tubular 104, a hydraulic setting apparatus 113 disposed at an upper end of the inner tubular 104, and a floating piston 134 located below the hydraulic setting apparatus 113. Common liner running components such as a packer actuator, releasing tool, cementing pack-off, and wiper plugs, make up the remainder of the running tool assembly 105 and will be discussed in further detail below. A landing string (not shown) can be used to lower, support, and retrieve the running tool assembly 105 and the liner hanger assembly 100 during operation. As illustrated in FIG. 1, a thin tubular sleeve 128 is positioned around the exterior of the PBR 130 and extends from above the PBR 130 to the packer 148. In FIG. 1, the hydraulic setting apparatus 113 is located adjacent to the upper end of the PBR 130. The hydraulic setting apparatus 113 includes a setting piston 110 and a hydraulic actuation piston 118. The setting piston 110 is sealably disposed on the inner diameter of the PBR 130 and is connected to an upper portion of the thin tubular sleeve 128 by an upper locking dog 124. The setting piston 110 is also selectively connected to an upper portion of the PBR 130 by a lower locking dog 126. The hydraulic actuation piston 118 is sealably engaged to the outer diameter 171 of the inner tubular 104 and is disposed between the inner tubular 104 and the setting piston 110. In one embodiment, the actuating piston 118 is selectively connected to the setting piston 110 using a shearable screw 114. Although, locking dogs 124, 126 and shearable screw 114 are used to secure the setting piston 110, other releasable securing devices such as collets, frangible members, and any others known to a person of ordinary skill in the art may be used.

As shown in FIG. 1, the floating piston 134 is disposed between the hydraulic setting apparatus 113 and the cementing pack-off 142. The floating piston 134 is sealably and movably disposed on a sealing surface 183 of the tubular 104. A fluid chamber 141 is formed between the inner tubular 104 and the floating piston 134. Preferably the floating piston 134 is biased so that it is in an intermediate position with respect to its permitted travel when no external pressures or forces are applied to it. This may be accomplished in the preferred embodiment by compression springs 136 and 140. The cementing pack-off 142 is disposed below the floating piston 134. The cementing pack-off 142 serves to prevent the upward flow of cement (not shown) through the annular area between the liner body 146 and the polished mandrel 173. Together the tubular 104, the setting piston 110, the actuating piston 118, the PBR 130, the liner body 146, the cementing pack-off 142, polished mandrel 173, and the running tool components between the cementing pack-off 142 and the floating piston 134 form a contained fluid chamber 139. The floating piston 134 serves to transmit pressure to the inside of the contained fluid chamber 139 without direct fluid communication to the working fluid (not shown) in the tubular 104. A port 138 is disposed through the tubular 104 and places the fluid in the tubular 104 in communication with the fluid chamber 141.

The hydraulic setting apparatus 113 may also contain hydraulic control devices including a rupture disc 117 and a check valve 116 disposed on the hydraulic actuation piston 118, which serve to control the pressure within the PBR fluid chamber 139 by regulating the ingress and exit of annular fluid from the fluid chamber 139. A filter screen 112 is disposed on the outside of the setting piston 110. The filter screen 112 functions to segregate solids from the fluid entering the fluid chamber 139 through the above devices. The hydraulic setting apparatus 113 is configured to transmit an upward force from the hydraulic actuating piston 118 and the setting piston 110 to the outer tubular sleeve 128.

Near the lower end of the PBR 130, the outer tubular sleeve 128 traverses underneath the packing element 177 and connects to a first shoulder member 150 that is further attached to a second shoulder member 152. The second shoulder member 152 comprises the upper portion of the liner hanger 176 and acts to transmit an upward force to a plurality of slips 162 resulting from the upward movement of the outer tubular sleeve 128.

The liner hanger 176 also includes a plurality of cones 160 disposed on the outer diameter of the liner body 146 and configured to orient the plurality of slips 162 radially outward to engage the casing 166, as shown in FIG. 2. A thrust bearing 151 is disposed between the second shoulder member 152 and the liner body 146 proximate the upper portion of the cones 160. A one-way ratchet profile 154 is disposed on the exterior of the cylindrical upper portion of the cones 160. A connecting ring 163 is attached to the slips 162 to maintain the slips 162 in the same axial position relative to their respective cones 160. The connecting ring 163 includes a ratchet ring 156 that serves to matingly engage the ratchet profile 154 thereby allowing the slips 162 to only travel in an upward direction. A biasing member 158, such as a compression spring, is disposed between the cones 160 and the ratchet profile 154 to lock in the setting force applied by the hydraulic setting apparatus 113 into the slips 162 and cones 160.

The liner hanger assembly 100 and running tool assembly 105 as shown in FIG. 1 are assembled to a liner tubular 103 and prepared at the surface. The assemblies 100, 105 are adapted to hang and seal a liner tubular 103 to an existing casing in the wellbore. Before being run into the wellbore, the PBR fluid chamber 139 on the liner hanger assembly 100 is filled through a fill port 119 disposed through the setting piston 110 with a clean fluid, such as water. The liner hanger assembly 100 and running tool assembly 105 are then run into the wellbore on a landing string (not shown) to a desired setting depth. The floating piston 134 and the one way check valve 116 serve to compensate for any variation in the volume of the PBR fluid chamber 139 due to fluctuations in the temperature or pressure of the fluid while the liner hanger assembly 100 is being run into the wellbore.

Once the liner hanger assembly 100 has reached the desired setting depth, a ball or other suitable device (not shown) is deployed from the surface through the landing string until landing on a ball-seat (not shown) positioned below the liner hanger assembly 100 thereby preventing the fluid from flowing below the ball-seat and allowing the fluid above the seat to be pressurized. The pressurized fluid within the tubular 104 will enter the chamber 141 through the port 138 causing the floating piston 134 to travel downward to a position, as illustrated in FIG. 2. Accordingly, the downward movement of the floating piston 134 will compress the fluid in the PBR fluid chamber 139 until the pressure in the PBR fluid chamber 139 and the pressure in tubular 104 are equal. The check valve 116 is configured to prevent fluid from exiting fluid chamber 139. The increased pressure in the PBR fluid chamber 139 is applied to the hydraulic actuation piston 118 and the setting piston 110 of the hydraulic setting apparatus 113. The differential pressure between the PBR fluid chamber 139 and the annulus 168 between the running tools and the casing urges the actuating piston 118 upward along the outer diameter 171 of the tubular 104. When the pressure in the chamber 139 reaches a predetermined pressure, the shear screw 114 on the hydraulic actuation piston 118 will release or shear, thereby allowing the 114 actuating piston 118 to move axially with respect to the PBR 130. Since the actuating piston 118 is positioned around the inner tubular 104 the seal contact area is relatively small.

A sufficient upward travel of the actuating piston 118 releases the lower locking dog 126 from the PBR 130. The actuating piston 118 shoulders against the setting piston 110 and the combined piston area is from the inner diameter of the PBR 130 to the outer diameter 171 of the inner tubular 104,thereby creating a large piston area for the pressure to be applied across. The upper locking dog 124 transmits the upward motion of the setting piston 110 to the thin tubular sleeve 128. As previously described, the outer tubular sleeve 128 transmits this upward force to the liner hanger 176 through the first and second shoulder members, 150 and 152, respectively. In turn, the second shoulder member 152, which connects to an upper portion of the slips 162, urges the slip 162 upward against the tapered surface of the cones 160 disposed on the liner body 146 causing the slips 162 to extend radially outward towards the casing 166. The slips 162 continue to expand radially until the gripping surface 165 on the exterior of the slips 162 engages the inner diameter of the casing 166. Additional hydraulic setting force acts to fully compress the spring 158 located above the cones 160. Accordingly, the ratchet ring 156 will lock into position on the ratchet teeth profile 154 to prevent the slips 162 from moving back down the tapered surfaces of the cones 160 and to maintain the setting force on the slips 162 supplied by the biasing member 158.

The engagement of the slips 162 onto the casing 166 allows the liner hanger assembly 100 to carry the weight of the liner tubular 103 at which point the support provided by the landing string (not shown) to the running tool assembly 105 from the surface to suspend the liner hanger assembly 100 and liner tubular 103 in position may be relieved. The weight of the liner tubular 103 is transmitted from the liner body 146 through the cones 160, to the slips 162 which are in frictional engagement with the casing 166. Any upward pull through liner body 146 is transmitted through load ring 174 into the upper part of cone 160 above the biasing member 158. The force is then transferred to connector ring 163 and to the slips 162 and casing 166 via ratchet ring 156. The slips 162 provide moderate hold down capacity in this configuration. An over-pull on the landing string may be used to confirm that the liner hanger assembly 100 is set in place by ensuring that the no upward movement of the liner hanger assembly 100 occurs during the over-pull.

Additional hydraulic pressure on the hydraulic actuation piston 118 from the fluid chamber 139 will open the pressure control mechanism 117, such as a rupture disc, disposed through the hydraulic actuation piston to place the annulus 168 between the running tools and the casing in communication with the PBR fluid chamber 139 thereby allowing the pressure in the chamber 139 and annulus 168 to equalize. The pressure required to open the pressure control mechanism 117 is set higher than the pressure required to urge the setting piston 110 upward and fully engage the slips 162 with the casing 166. In response to fluid exiting through the open pressure control mechanism 117, the floating piston 134 will travel downward until a travel stop 132 disposed at an upper portion of the floating piston 134 reaches a shoulder 133 protruding from the inner tubular 104 wherein the floating piston 134 has reached the end of its stroke.

A new pressure differential can then be established between the fluid in the tubular 104 and the PBR fluid chamber 139. This pressure differential may be used to release liner hanger assembly 100 from the running tool assembly 105. In one embodiment, pressurized fluid entering port 180 deactivates a frangible member 181 holding the piston 179 and urges the piston 179 to move upward. Continual upward movement of the piston 179 causes a release mechanism, such as a collet 167, to release from the liner body 146. As a result, the running tool assembly 105 is released from the liner hanger assembly 100.

In order to confirm that the liner hanger assembly 100 has been released, the running tool assembly 105 and landing string are raised upward from the surface. Additional assurance that the liner hanger assembly 100 remains stationary while picking up the running tool assembly 105 is provided by the hold down capabilities of the liner hanger assembly 100. Preferably the outer diameter 171 of the inner tubular 104 on the hydraulic setting apparatus 113 and the outer diameter 172 on the polished mandrel 173 through the cementing pack-off 142 are of the same diameter, thereby allowing the running tools to be raised and lowered without changing the volume within the PBR chamber 139. If the diameters are not the same, the change in volume can be compensated for by the floating piston 134 and/or fluid influx through the control device 117, such as a rupture disc, which is now open with respect to the annulus 168. All fluid entering the fluid chamber 139 is directed through the screen 112 to prevent entry of solids that could cause retrieval of the running tools to be more difficult.

The running tool assembly 105 remains within the liner hanger assembly 100 as it is lowered back into contact with the liner hanger assembly 100. The ball or sealing device (not shown) may now be released so that it no longer impedes fluid passage in the tubular 104. This is typically accomplished by pressuring up to a higher pressure against a ball seat located below the liner hanger 176 held by frangible members (not shown) at which point they break at a predetermined pressure and the seat moves from its sealing position to an open position, thereby re-establishing fluid communication with the annulus below the ball seat (not shown). Provisions for rotation of the liner body 146 during cementing are provided for in the liner hanger 176 by the thrust bearing 151 located between the upper part of cone 160 and liner body 146, which allows the slips 162 and cones 160 to remain stationary with respect to the casing 166 while the liner body 146 and liner hanger assembly 100 rotate. During cementing operations wherein cement (not shown) is pumped down the landing string, the tubular 104, and around the bottom of the liner tubular 103 to fill the annular area 168 between the liner tubular 103 and the casing 166. As described above, the cementing pack-off 142 prevents the inadvertent upward flow of cement to the PBR fluid chamber 139.

After the cementing operations are completed, further pick up of the running tool assembly 105 by the landing string causes the shoulder 175 under the actuation piston 118 on inner tubular 104 to contact release sleeve 120, thereby moving it upward so that it compresses biasing member 122. This releases the setting piston 110 from the thin tubular sleeve 128 by allowing the upper locking dogs 124 to move from their locked position to an unlocked position. As shown in FIG. 3, further upward movement of the running tool assembly 105 past the thin tubular sleeve 128 allows a packer actuator to extend radially. A shoulder on the packer actuator 170 may now engage the top of the thin tubular sleeve 128 to transmit a downward force to the tubular sleeve 128. The downward force applied to the sleeve 128 acts to expand the sealing element 177 on the packer 148 to form a seal with the casing 166, as illustrated in FIG. 3. A pressure test may be performed on the packer 148 at this time to ensure its sealing performance. Further pick up of the running tool assembly 105 by the landing string will disengage the cementing pack-off 142 and allow the run-in tool assembly 105 to be retrieved with the landing string. The thin tubular sleeve 128 may be left in the well or retrieved along with the run-in tool assembly 105.

Figure 4:
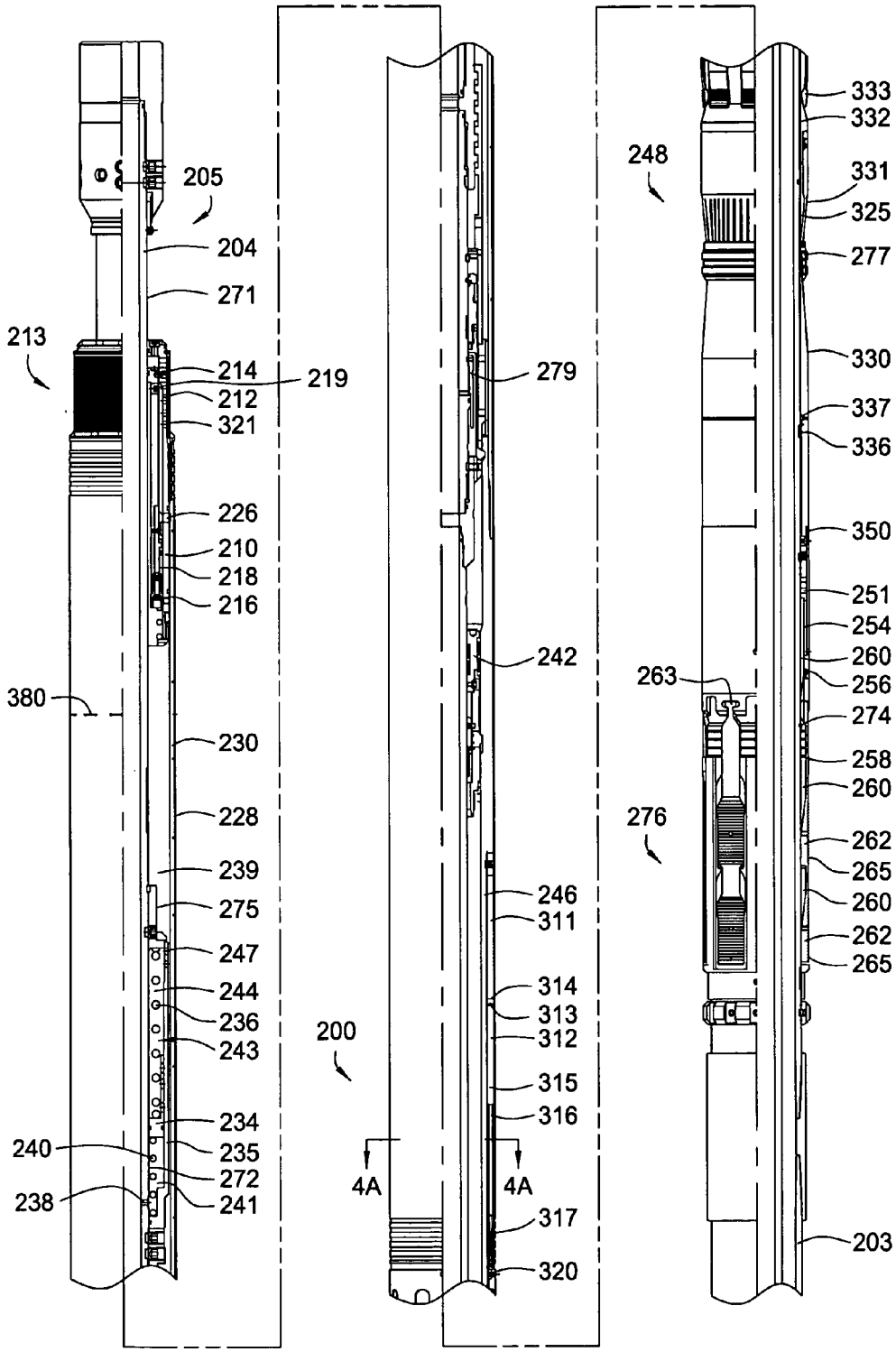
FIG. 4 illustrates a partial schematic view another embodiment of a liner hanger assembly and a running tool assembly in a run-in position.
Figure 5:
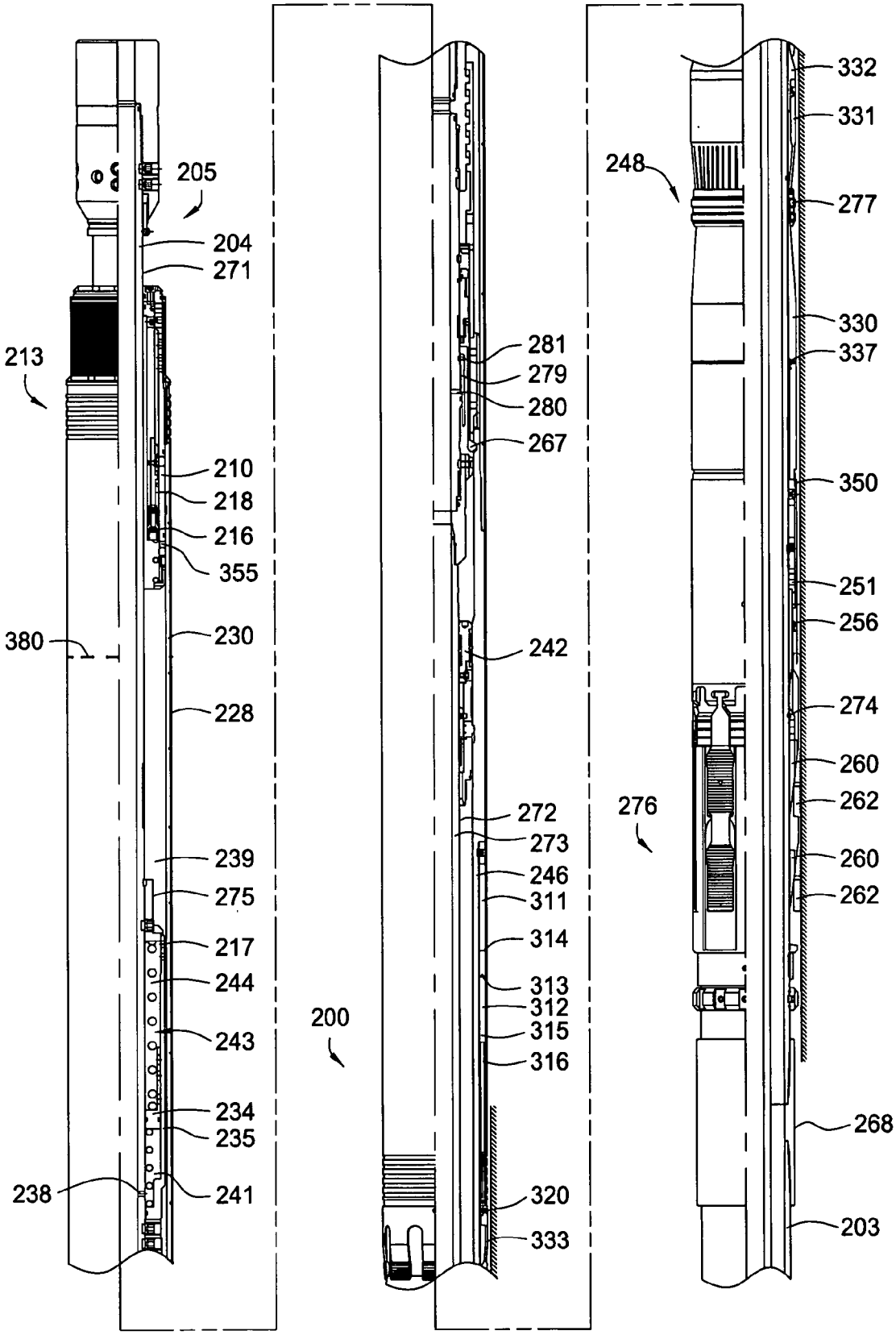
FIG. 5 illustrates a partial schematic view of the liner hanger assembly and the running tool assembly set within a wellbore and the packer decoupled from the liner hanger.
Figure 6:
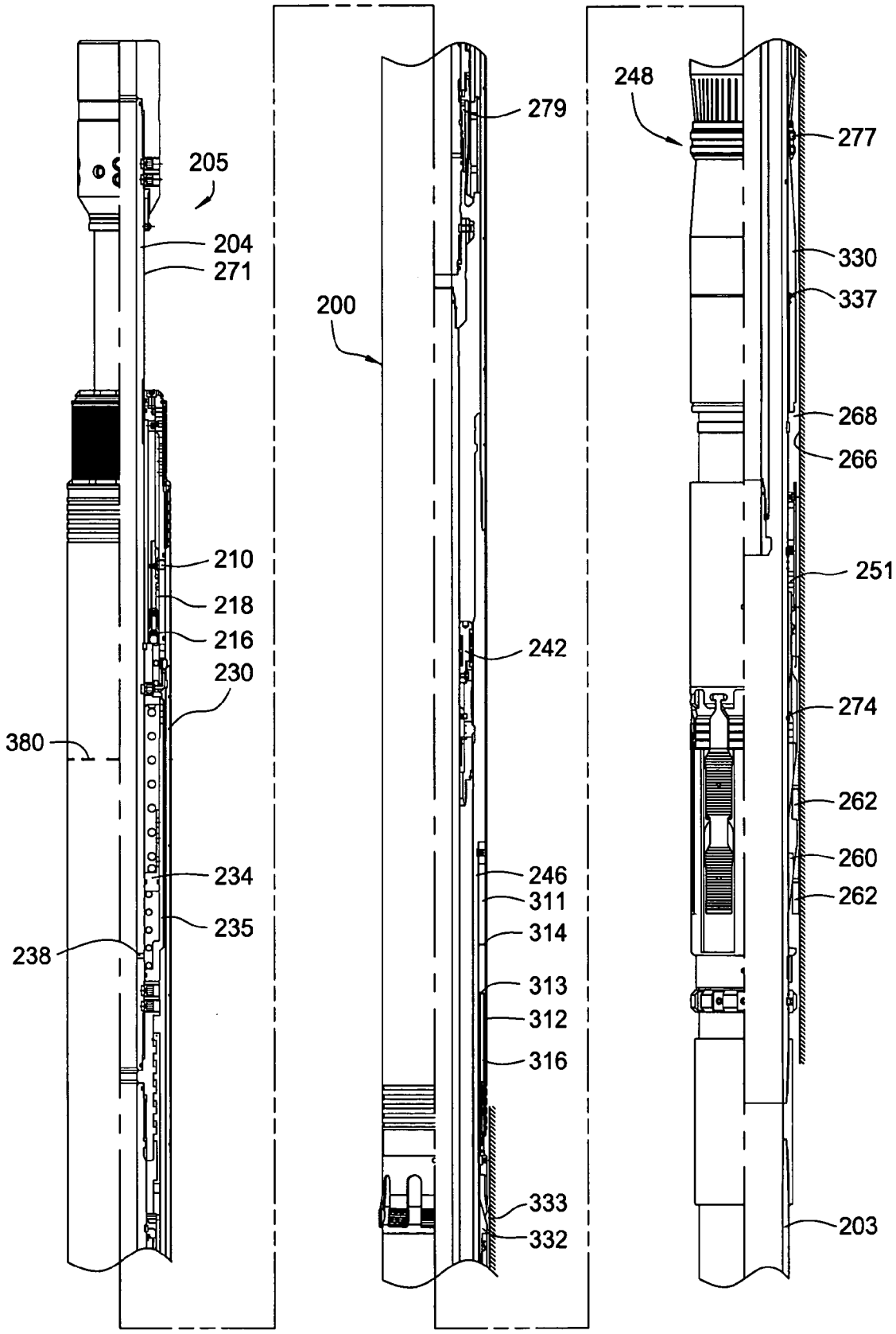
FIG. 6 illustrates a partial schematic view of the liner hanger assembly and the running tool assembly after the running tool assembly has been released and setting of the liner top packer has just begun.
Figure 7:
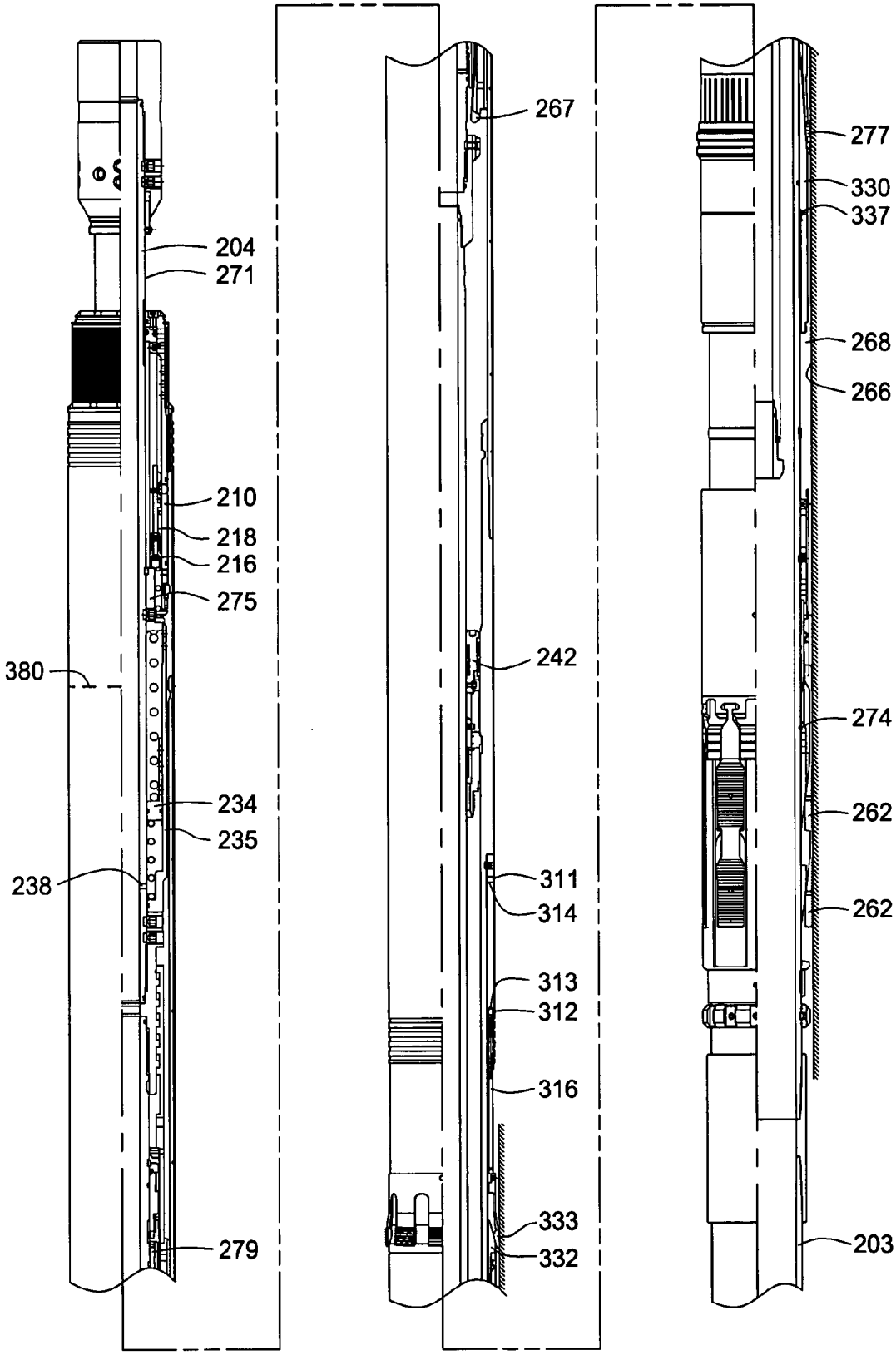
FIG. 7 illustrates a partial schematic view of the liner hanger assembly and the running tool assembly in the liner top packer actuated position.

Aspects of the present invention also provide a liner hanger assembly 200 and a running tool assembly 205 adapted to activate the packer 248 and the liner hanger 276 using tension as a setting force. FIG. 4 illustrates a partial schematic view of the assemblies 200, 205 in a run-in position. FIG. 5 illustrates a partial schematic view of the assemblies 200, 205 with the liner hanger 276 set within a wellbore and the packer 248 decoupled from the liner hanger 276. FIG. 6 illustrates a partial schematic view of the assemblies 200, 205 after the running tool assembly 205 has been released and after setting of the liner top packer 248 has just begun. FIG. 7 illustrates a partial schematic view of the assemblies 200, 205 in the liner top packer actuated position.

The liner hanger assembly 200 generally includes a polished bore receptacle (PBR) 230, a liner top packer 248, and a liner hanger 276. As shown in FIG. 4, the PBR 230 is disposed above the packer 248. In FIG. 4, the PBR 230 is shown rigidly connected to a liner body 246 by a metal to metal sealing, threaded connection; however, it is assumed that the PBR may be attached to the liner body 246 by any connection means known to a person of ordinary skill in the art or the PBR 230 can be an integral part of the liner body 246. The liner top packer 248 is shown on a common liner body 246 with the liner hanger 276; however, it is assumed that they could have two separate bodies threadedly coupled together.

The running tool assembly 205 generally includes an inner tubular 204, a hydraulic setting apparatus 213 disposed at an upper end of the inner tubular 204, and a cylinder 235 having a floating piston 234 located below the hydraulic setting apparatus 213. Common liner running components such as a packer actuator, releasing tool, cementing pack-off, and wiper plugs, make up the remainder of the running tool assembly 205 and will be discussed in further detail below. A landing string (not shown) can be used to lower, support, and retrieve the running tool assembly 205 and the liner hanger assembly 200 during operation. As illustrated in FIG. 4, a thin tubular sleeve 228 is positioned around the exterior of the PBR 230 and extends from above the PBR 230 to the packer 248. In FIG. 4, the hydraulic setting apparatus 213 is located adjacent to the upper end of the PBR 230. The hydraulic setting apparatus 213 includes a setting piston 210 and a hydraulic actuation piston 218. The setting piston 210 is sealably disposed on the inner diameter of the PBR 230 and is selectively connected to the PBR 230 by a locking dog 226. The setting piston 210 is also connected to an upper portion of the outer sleeve 228. The hydraulic actuation piston 218 is sealably engaged to the outer diameter 271 of the inner tubular 204 and is disposed between the inner tubular 204 and the setting piston 210. In one embodiment, the actuating piston 218 is selectively connected to the setting piston 210 using a shearable screw 214. Although, locking dog 226 and shearable screw 214 are used to secure the pistons 210, 218, other releasable securing devices such as collets, frangible members, and any others known to a person of ordinary skill in the art may be used.

The cementing pack-off 242 is disposed near the bottom of the running tool assembly 205. The cementing pack-off 242 serves to prevent the upward flow of cement (not shown) through the annular area between the liner body 246 and the inner tubular 204. Together the inner tubular 204, the setting piston 210, the actuating piston 218, the PBR 230, the liner body 246, the cementing pack-off 242, and the running tool components form a contained fluid chamber 239.

As shown in FIG. 4, the cylinder 235 and floating piston 234 are disposed between the hydraulic setting apparatus 213 and the cementing pack-off 242. The cylinder 235 is disposed inside the chamber 239 and on a sealing surface of the inner tubular 204 such that a cylinder chamber 243 is formed. The floating piston 234 is sealably and movably disposed in the cylinder chamber 243 and is arranged and adapted to separate the cylinder chamber 243 into an upper chamber 244 and a lower chamber 241. The upper chamber 244 is in fluid communication with the contained fluid chamber 239 through one or more ports 247 formed in the cylinder 235. The lower chamber 241 is in fluid communication with the interior of the inner tubular 204 through a port 238 formed in the inner tubular 204. Preferably, the floating piston 234 is biased so that it is in an intermediate position with respect to its permitted travel when no external pressures or forces are applied to it. This may be accomplished in the preferred embodiment by compression springs 236 and 240. The floating piston 234 serves to transmit pressure to the inside of the contained fluid chamber 239 without direct fluid communication to the working fluid (not shown) in the tubular 204.

The hydraulic setting apparatus 213 may also contain hydraulic control devices including a check valve 216 disposed on the hydraulic actuation piston 218, which serve to control the pressure within the PBR fluid chamber 239 by regulating the ingress and exit of annular fluid from the fluid chamber 239 through one or more ports 321 formed on the setting piston 210. A filter screen 212 is disposed on the outside of the setting piston 210 segregate solids from the fluid entering the fluid chamber 239 through the ports 321. The hydraulic setting apparatus 213 is configured to transmit an upward force from the hydraulic actuating piston 218 and the setting piston 210 to the outer tubular sleeve 228.

Figure 4A:
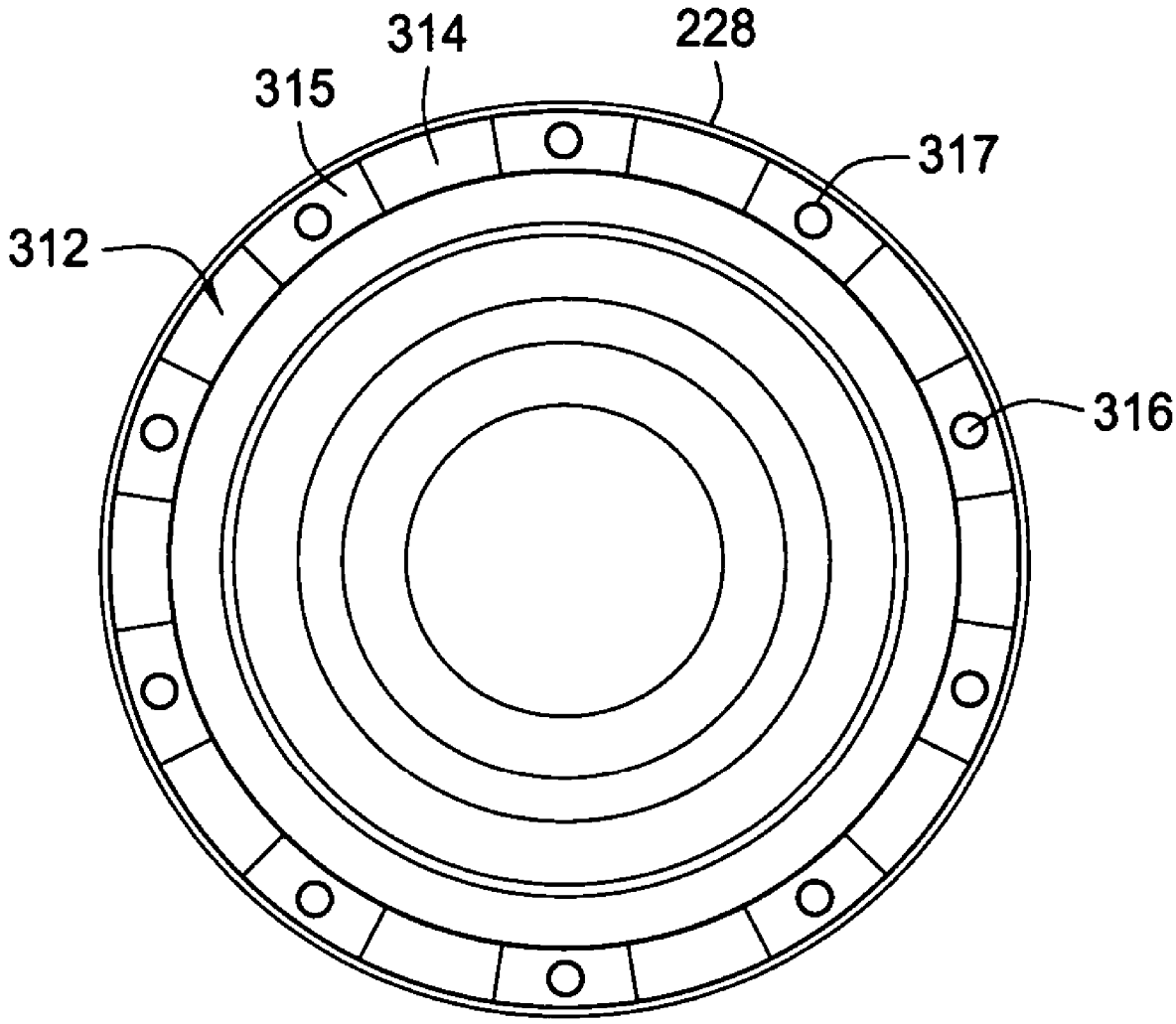
FIG. 4A is a cross-sectional view of the lower ring.

Near the lower end of the PBR 230, the outer tubular sleeve 228 is coupled to the packer 248 and the liner hanger 276 and is adapted to selectively actuate these two tools 248, 276. The lower portion of the outer tubular sleeve 228 below the PBR 230 is supported by two mating cylinder rings 311, 312. In the preferred embodiment, the upper and lower rings 311, 312, respectively, are mated using a finger and slot connection to allow relative axial movement therebetween. As shown in FIG. 4, the two rings 311, 312 are at an extended position wherein the fingers 313 of upper ring 311 have a short overlap with the fingers 314 of lower ring 312. The tubular sleeve 228 is attached to the non-slotted portion of the lower ring 312. The lower ring 312 includes one or more axial channels 317 for housing a rod 316. The rods 316 extend through the channel 317 and into a portion of the slot 315 in the lower ring 312. FIG. 4A is a cross-sectional view of the lower ring 312.

The packer 248 is connected to the lower ring 312 through a setting sleeve 325. A packer cone 330 is connected to the other end of the setting sleeve 325. Other components of the packer 248 are disposed on the setting sleeve and between the lower ring and the packer cone. The seal element 277 is initially disposed on the lower end of the incline of the packer cone during run-in. The seal element is attached to an extension arm 331 that is coupled to a cone 332 for a retaining slip 333. The retaining slip 333 is selectively connected to the setting sleeve using a shearable screw 320.

The liner hanger 276 is selectively connected to the lower end of the packer 248. In one aspect, the connection 350 between the packer cone and the liner hanger is adapted to allow the packer 248 and the liner hanger 276 to be activated using tension as the setting force. In the preferred embodiment, the packer 248 and the liner hanger are connected using a left hand engagement threaded connection 350. In this respect, after the liner hanger 276 has been activated, the liner may be rotated at the surface via the running tool assembly 205 to disengage the connection 350 that axially couples movement of the outer packer components with the liner hanger slips 263. A key 336 may be used to rotationally lock the packer cone 330 to the liner body 246. The lower half of connection 350 is held stationary by connecting ring 263, slips 262, and cones 260 which are engaged with the casing 266 when the hanger 276 has been set. The thrust bearing 151 permits rotation between these components and the liner body 246. The packer cone 330 may also include a ratchet ring 337 to ensure one way movement.

The liner hanger 276 includes a plurality of cones 260 disposed on the outer diameter of the liner body 246 and configured to orient the plurality of slips 262 radially outward to engage the casing 266, as shown in FIG. 5. In this embodiment, the liner hanger is provided with dual slips and cones. A thrust bearing 251 is disposed proximate the upper portion of the liner hanger 276. A one-way ratchet profile 254 is disposed on the exterior of the cylindrical upper portion of the upper cone 260. A connecting ring 263 is attached to the slips 262 to maintain the slips 262 in the same axial position relative to their respective cones 260. The connecting ring 263 includes a ratchet ring 256 that serves to matingly engage the ratchet profile 254 thereby allowing the slips 262 to only travel in an upward direction. A biasing member 258, such as a compression spring, is disposed between the cones 260 and the ratchet profile 254 to lock in the setting force applied by the hydraulic setting apparatus 213 into the slips 262 and cones 260.

Before being run into the wellbore, the PBR fluid chamber 239 on the liner hanger assembly 200 is filled through a fill port 219 disposed through the setting piston 210 with a clean fluid, such as water. The liner hanger assembly 200 and running tool assembly 205 are then run into the wellbore on a landing string (not shown) to a desired setting depth. The floating piston 234 and the one way check valve 216 serve to compensate for any variation in the volume of the PBR fluid chamber 239 due to fluctuations in the temperature or pressure of the fluid while the liner hanger assembly 200 is being run into the wellbore.

Once the liner hanger assembly 200 has reached the desired setting depth, a ball or other suitable device (not shown) is deployed from the surface through the landing string until landing on a ball-seat (not shown) positioned below the liner hanger assembly 200 thereby preventing the fluid from flowing below the ball-seat and allowing the fluid above the seat to be pressurized. The pressurized fluid within the tubular 204 will enter the lower chamber 241 through the port 238 and cause the floating piston 234 to travel upward, thereby increasing the pressure in the PBR fluid chamber 239. The check valve 216 is configured to prevent fluid from exiting fluid chamber 239. The increased pressure in the PBR fluid chamber 239, in turn, causes the shearable screw 214 to fail, thereby releasing the actuation piston 218 from the setting piston 210. Once released, the pressure in the fluid chamber 239 urges the actuation piston 218 to move upward with respect to the setting piston 210.

A sufficient upward travel of the actuating piston 218 releases the locking dog 226 from the PBR 230. The actuating piston 218 shoulders against the setting piston 210 and forms a larger combined piston area for the pressure to be applied across. Because the thin tubular sleeve 228 is attached to the setting piston 210, further upward movement of the pistons 210, 218 also causes upward movement of the thin tubular sleeve 228.

Upward movement of the thin tubular sleeve 228 activates the liner hanger 276. As previously described, the outer tubular sleeve 228 transmits this upward force to the liner hanger 276 through the packer 248 and the disengagement connection 350. In turn, the slips 262 are urged upward against the tapered surface of the cones 260 disposed on the liner body 246, thereby causing the slips 262 to extend radially outward towards the casing 266, as shown in FIG. 5. The slips 262 continue to expand radially until the gripping surface 265 on the exterior of the slips 262 engages the inner diameter of the casing 266. Additional hydraulic setting force acts to fully compress the spring 258 located above the cones 260. Accordingly, the ratchet ring 256 will lock into position on the ratchet teeth profile 254 to prevent the slips 262 from moving back down the tapered surfaces of the cones 260 and to maintain the setting force on the slips 262 supplied by the biasing member 258.

The engagement of the slips 262 onto the casing 266 allows the liner hanger assembly 200 to carry the weight of the liner tubular 203 at which point the support provided by the landing string (not shown) to the running tool assembly 205 from the surface to suspend the liner hanger assembly 200 in position may be relieved. The weight of the liner hanger assembly 200 is transmitted from the liner body 246 through the cones 260, to the slips 262 which are in frictional engagement with the casing 266. Any upward pull through liner body 246 is transmitted through load ring 274 into the upper part of cones 260 above the biasing member 258. The force is then transferred to connector ring 263 and to the slips 262 and casing 266 via ratchet ring 256. The slips 262 provide moderate hold down capacity in this configuration. An over-pull on the landing string may be used to confirm that the liner hanger assembly 200 is set in place by ensuring that the no upward movement of the liner hanger assembly 200 occurs during the over-pull.

After the liner hanger 276 is set, the packer 248 maybe decoupled from the liner hanger 276. Initially, the pressure in the inner tubular 204 is bled off at the surface. Thereafter, the running tool assembly 205 and the liner tubular 203 are rotated to the right to disengage the connection 350 with the liner hanger 276, as shown in FIG. 5.

The running tool 205 may now be released from the liner body 246, as shown in FIG. 6. Initially, pressure is again supplied from the surface to pressurize the lower chamber 241. The pressurized fluid urges the floating piston 234 to move upward and increase the pressure in the PBR fluid chamber 239. The increased pressure causes the setting piston 210 and the actuation piston 218 to move upward relative to the PBR 230 until a relief port 355 in the setting piston 210 moves past the PBR 230, thereby placing the PBR fluid chamber 239 in fluid communication with the annulus 268. Opening of the relief port 355 reduces the pressure in the fluid chamber 239 and allows the floating piston 234 to continue to move upward in the cylinder chamber 243 to its maximum stroke. Thereafter, pressurized fluid enters port 280, deactivates a frangible member 281 retaining the piston 279, and urges the piston 279 to move upward. Continual upward movement of the piston 279 causes a collet 267 to release from the liner body 246. As a result, the run-in tool assembly 205 is released from the liner hanger assembly 200. To confirm that the liner hanger assembly 200 has been released, the running tool assembly 205 and landing string are raised upward from the surface. Additional assurance that the liner hanger assembly 200 remains stationary while picking up the running tool assembly 205 is provided by the hold down capabilities of the liner hanger assembly 200. Preferably, the outer diameter 271 of the inner tubular 204 on the hydraulic setting apparatus 213 and the outer diameter 272 on the polished mandrel 273 through the cementing pack-off 242 are of the same diameter, thereby allowing the running tools to be raised and lowered without changing the volume within the PBR chamber 239. The ball or sealing device (not shown) may now be released so that it no longer impedes fluid passage in the tubular 204. This is typically accomplished by pressuring up the inner tubular 204 to a predetermined pressure to cause frangible members retaining a ball seat located below the liner hanger 276 to break, thereby moving the seat from its sealing position to an open position to re-establish fluid communication with the annulus below the ball seat (not shown). Rotation of the liner body 246 during cementing are provided for in the liner hanger 276 by the thrust bearing 251 located at the upper portion of the liner hanger 276. The thrust bearing 251 allows the slips 262 and cones 260 to remain stationary with respect to the casing 266 while the liner body 246 and liner tubular 203 rotate. During cementing operations wherein cement (not shown) is pumped down the landing string, the tubular 204, and around the bottom of the liner tubular 203 to fill the annular area 268 between the liner tubular 203 and the casing 266. As described above, the cementing pack-off 242 prevents the inadvertent upward flow of cement to the PBR fluid chamber 239.

The running tool assembly 205 may now be used to set the packer 248 by applying tension force. Initially, the running tool assembly 205 is pulled upwards until an upper end 275 of the floating piston cylinder 235 contacts the actuation piston 218. Thereafter, continual upward pull causes the tubular sleeve 228 to also move upward. The packer is pulled upward until the rod 316 contacts the finger 313 of the upper ring 311. Because the packer is prevented from moving further, the upward pull of the running tool assembly 205 causes the shearable screw 320 to fail, thereby releasing the setting sleeve 325 from the retaining slip 333. At this point, moving the cone 332 for the retaining slip 333 toward the slip 333 will extend the slip 333 radially into engagement with the casing 266 due to the incline on the cone 332, as illustrated in FIG. 6. It can also be seen that the lower ring 312 has moved relative to the rod 316 and the overlap between the upper ring 311 and the lower ring 312 has increased.

Engagement of the retaining slip 333 with the casing 266 limits the upward travel of the seal element 277. As a result, the packer cone 330 is urged toward the seal element 277 and expands the seal element 277 into engagement with the casing 266, thereby sealing off the annulus 268. The one way ratchet ring 337 in the packer cone 330 assists in maintaining the integrity of the seal formed. In this respect, the present invention provides a packer 248 that can be set using tension.

After the packer 248 is set, continued pick up of the running tool assembly 205 causes the tubular sleeve 228 to separate at the perforation 380, which may be seen in FIG. 7. Thereafter, the running tool assembly 205 may be retrieved from the wellbore, leaving the behind the liner hanger assembly 200 and liner tubular 203.

While the devices and methods described above incorporate a packer, it is within the scope of this invention that a liner hanger and hydraulic setting tools of the above description may be utilized without the packer.

While the foregoing is directed to embodiments of the present invention, other and further embodiments of the invention may be devised without departing from the basic scope thereof, and the scope thereof is determined by the claims that follow.

We claim:

1. A liner hanger comprising:

a tubular for running into a wellbore having:

a gripping member radially moveable in response to axial movement;

a polished bore receptacle axially fixed relative to the gripping member;

a fluid actuated motive member for moving the gripping member axially wherein the fluid actuated motive member is removeable from the wellbore subsequent to its operation; and a floating piston for actuating the motive member.

2. The liner hanger of claim 1, wherein the motive member is a piston.

3. The liner hanger of claim 2, wherein the piston is attachable to a second tubular for actuating the gripping member.

4. The liner hanger of claim 3, wherein the second tubular is disposed on the outer diameter of the polished bore receptacle.

5. The liner hanger of claim 1, wherein the floating piston is in fluid communication with the interior of the tubular.

6. The liner hanger of claim 1, further including a check valve.

7. The liner hanger of claim 1, wherein the gripping member is a slip.

8. A method for setting a tool in a wellbore comprising:

setting a liner hanger in a tubular therearound wherein the liner hanger comprises a polished bore receptacle connected to a gripping assembly and fixed relative to the gripping assembly;

pressurizing a chamber;

transmitting a motive force to the gripping assembly in response to the pressurizing thereby affixing the liner hanger in the tubular; and actuating a floating piston to pressurize the chamber.

9. The method for selling a tool in claim 8, further comprising actuating the floating piston with fluid pressure from the interior of the tubular.

10. The method for setting a tool in claim 8, wherein the motive force is created by a piston.

11. The method for setting a tool in claim 8, further comprising regulating pressure in the chamber with a check valve.

12. The method for setting a tool in claim 8, wherein the motive force is transmitted in sleeve located on the outer diameter of the polished bore receptacle.

13. A method for setting a tool in a wellbore, comprising:

disposing a first tubular around a second tubular;

compressing a fluid reservoir by hydraulically actuating a piston;

transmitting an axial force to the first tubular by compressing the fluid reservoir;

moving the first tubular axially relative to the second tubular; and actuating a gripping member operatively connected to the first tubular, the second tubular being fixed relative to the gripping member, wherein the gripping member sets the tool in the wellbore.

14. A setting tool for use in a wellbore, comprising:

a first tubular member;

an inner tubular disposed within the inner diameter of the first tubular, the interior of the inner tubular in fluid communication with a fluid chamber, a piston operable by the fluid chamber;

a fluid reservoir;

a second tubular member disposed around the outer diameter of the first tubular member and axially movable relative to the first tubular member, the second tubular attached to a force application member actuatable by the fluid reservoir; and a gripping member operatively connected to the second tubular member, the gripping assembly actuatable by the force transmitted to the second tubular member.

15. The tool of claim 14, wherein upon actuation of the piston the fluid reservoir is compressed.

* * * * *

UNITED STATES PATENT AND TRADEMARK OFFICE

CERTIFICATE OF CORRECTION

PATENT NO. : 7,114,573 B2
APPLICATION NO. : 10/850349
DATED : October 3, 2006
INVENTOR(S) : David E. Hirth and Patrick G. Maguire It is certified that error appears in the above-identified patent and that said Letters Patent is hereby corrected as shown below:

In the Claims section:

In column 15, Claim 9, line 32, please delete "selling" and insert --setting--.

Signed and Sealed this

Thirteenth Day of March, 2007

JON W. DUDAS
*Director of the United States Patent and Trademark Office*